United States Patent [19]

Fujii et al.

[11] Patent Number: 4,958,196

[45] Date of Patent: Sep. 18, 1990

[54] TONER RECOVERY DEVICE

[75] Inventors: Masaki Fujii; Hitoshi Tamura; Kuninori Suzuki, all of Hachioji; Noboru Hatakeyama, Sagamihara, all of Japan

[73] Assignee: Konica Corporation, Tokyo, Japan

[21] Appl. No.: 268,414

[22] Filed: Nov. 8, 1988

[30] Foreign Application Priority Data

Nov. 10, 1987 [JP] Japan ..... 62-282187

[51] Int. Cl.[5] ..... G03G 21/00

[52] U.S. Cl. ..... 355/298; 355/296; 366/128

[58] Field of Search ..... 355/298, 296; 366/128

[56] References Cited

U.S. PATENT DOCUMENTS 4,218,132 8/1980 Iwai et al. ..... 355/298 X
4,436,414 3/1984 Kamiyama et al. ..... 355/298
4,500,196 2/1985 Shimura ..... 355/298 X
4,590,814 5/1986 Wadensten ..... 366/128 X

FOREIGN PATENT DOCUMENTS 54369 3/1983 Japan .
231575 12/1984 Japan .

OTHER PUBLICATIONS

Patent Abstracts of Japan, vol. 6, No. 171, (P-140) (1049), Sep. 1982, JP 57088476.

*Primary Examiner*—Arthur T. Grimley
*Assistant Examiner*—Susan D. Luddy
*Attorney, Agent, or Firm*—Finnegan, Henderson, Farabow, Garrett, and Dunner

[57] ABSTRACT

The invention provides a toner recovery apparatus, wherein toner on the surface of photoreceptor is removed by a cleaning device and collected in a container. The image forming apparatus includes a stationary member having a toner inlet end and an opposite end. The toner recovery apparatus comprises a driving device for reciprocatingly moving the container along the stationary member. Bumper means are fixed to the stationary member for colliding with the container when the container moves towards the opposite end for applying negative acceleration to stop the movement of the container.

2 Claims, 3 Drawing Sheets

TONER RECOVERY DEVICE

BACKGROUND OF THE INVENTION

This invention relates to a toner recovery device or a toner-collecting device for an image forming apparatus such as an electrophotographic copying machine, in particular, to a toner recovery device that collects the toner remaining on the surface of an image carrying member such as a photosensitive drum by using a cleaning device that drops the toner into a container.

As a toner recovery device mentioned above, a device is disclosed in Japanese Patent Publication Open to Public Inspection (hereinafter referred to as Japanese Patent O.P.I. Publication) No. 54369/1983. This toner recovery device has a container that has a toner inlet at one end. By an eccentric rotary cam with a stepped peripheral surface, this container is deflected toward the toner inlet side as overcoming a spring force, and then the container is allowed to fall onto a small diameter area of the eccentric cam. The container is thereby repeatedly subjected to a negative acceleration wherein it's motion by spring force is stopped at the small diameter peripheral surface of the cam. However, this toner recovery device has a problem, since the motion of container by the spring force is prevented by the stepped eccentric cam to give negative acceleration to the container, the container oscillates vertically as well. Thus stable movement of toner caused by acceleration is hindered and toner tends to accumulate at the entrance of the toner inlet. Therefore, in order to contain a large amount of toner in the container, the height of the container must be large not only at the toner inlet section but also at the part which is away from this section it causes bulkiness of the image forming apparatus. Moreover, the collision to the cam causes serious wear of the cam and cam follower, resulting in poor durability of the toner recovery device and excessive noise.

There is another toner recovery device presented in Japanese Patent Publication Open to Public Inspection No. 231575/1984. This toner recovery device has a photo-sensor which detects the toner accumulated at a toner inlet, and lets a container be vibrated forcibly. For this purpose a lump of toner must be formed. Thus, since the height of the container must be increased, it is difficult to realize a compact image forming apparatus.

SUMMARY OF THE INVENTION

This invention has been made to solve the problems of prior art toner recovery devices described above, and therefore, the object of the invention is to provide a toner recovery device less prone to generate impact noise or vertical vibration, wherein an interval for removing toner from a toner container can be longer since even a container, designed with a toner inlet at one end and having a low profile, can fully store toner, whereby a compact image forming apparatus is realized.

The invention provides to a toner recovery device characterized in that toner on the surface of an image carrying member in an image forming apparatus is removed by a cleaning device and dropped into a toner container, wherein the container has a toner inlet at one end and is reciprocated along a straight line between the toner inlet-side and the opposite side. Thus every time when the container is moved toward the opposite side, the container collides with a fixed collision member and is given a negative acceleration. The previously mentioned objective can be achieved with such an arrangement.

DETAILED DESCRIPTION OF THE INVENTION

The present invention will be described with an embodiment shown by drawings.

Figure 1:
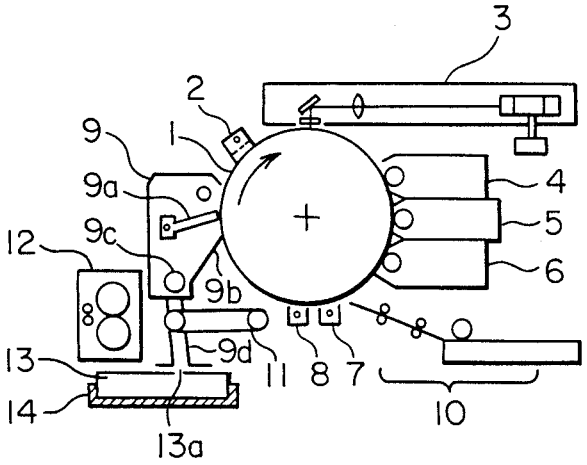
FIG. 1 schematically illustrates a side view of an image forming apparatus having a toner recovery device according to this invention.

In the image forming apparatus shown in FIG. 1, a photosensitive drum 1 which is an image carrying member rotates in the direction shown with an arrow. A corona charging electrode 2 uniformly charges the surface of the photosensitive drum 1. An image exposing unit 3 which uses a laser beam scanner, such as semiconductor laser beam scanner, exposes on the charged surface of the photosensitive drum 1, thereby an electrostatic latent image to corresponding to an electrical image information is made on the drum. One of developing units 4, 5, and 6 develops the electrostatic latent image into a toner image of either yellow, cyan, or magenta. Once the surface of the photosensitive drum 1, having a toner image, passes inactive devices of a transfer electrode 7, a separation electrode 8, and a cleaning device 9, it starts the second rotation, there occur electrification with the corona changing electrode 2, formation of an electrostatic latent image with the image exposing unit 3, and development by a developing unit selected from one of the developing units 4, 5, and 6. When the drum 1 makes the third rotation, the same procedures are repeated, thereby a color image consisting of the toner images of three colors is formed on the photosensitive drum 1. With the transfer electrode 7, this color image is transferred onto a recording sheet which is fed by sheet feeding means 10. The recording sheet having the so-transferred color image is separated from the photosensitive drum 1 by the separation electrode 8 and is transported to a fixing unit 12 by a delivering unit 11. Once the color image is fixed onto the recording sheet by the fixing unit 12, the sheet is discharged from the machine. Toner remaining on the surface of the photosensitive drum 1 from which the color image has been transferred is removed by the cleaning device 9. The surface of the drum is thereby prepared for the next cycle of color image formation.

The cleaning device 9 scrapes toner on the photosensitive drum 1 using a scraping member **9*a*, transports the scraped toner to toner transporting means 9*c* along a guide plate 9*b*, then shifts the toner laterally to one end of the cleaning device 9 by toner transporting means 9*c*, and drops into a container 13 via a chute 9*d* formed on the above-mentioned end. The embodiment shown in the figure uses a blade as the scraping member 9*a* and a screw conveyor as the toner transporting means 9c**. However, the invention is not limited only to such an arrangement. For example, it is possible to scrape toner with a rotary brush and transport it with a conveyor, or the like.

In the embodiment shown in FIG. 1, the container 13 is installed in a narrow space below the delivery unit 11 and the fixing unit 12 so as to make the image forming apparatus compact. Accordingly, the fall of the toner is greater, and the toner does not form a heap in the container 13 and moves through the entrance of the toner inlet 13a, deep into the container 13. In addition, the chute 9d is clear of the delivery unit 11, and the connection between the chute 9d and the container 13 is located under the delivery means 11. Therefore, even if the toner leaks from the connection between the chute and the container 13, a recording sheet will not be contaminated. Moreover, a certain designing latitude is available; as the container 13 gets filled with toner, it can be removed leftward, or either frontward or rearward, to dispose of the toner. However, the scope of this invention is not limited to this example.

Figure 2:
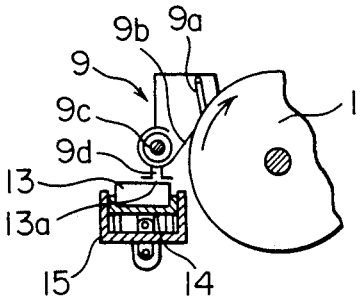
FIGS. 2 and 3 are a partial side view and a partial front view of an example of toner recovery device according to this invention.
Figure 3:
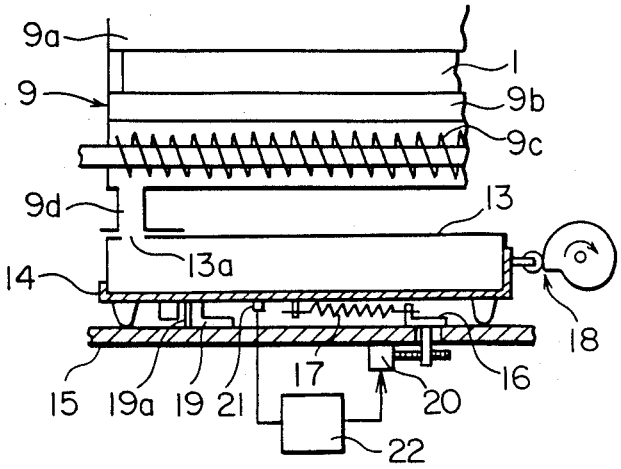

In FIG. 1, a drive mechanism of the container 13 is not shown. However, since its mechanism is similar to that of a container 13 shown in FIG. 2 or 3, the container 13 will be explained by mainly using FIGS. 2 and 3. In FIGS. 2 and 3, the container 13 is disposed below a cleaning device 9, while a delivery unit 11 and the fixing unit 12 are not shown.

The container 13 is, as shown in FIGS. 1 through 3, equipped with the toner inlet 13a at its one end and is subjected to a movement that enables the container to be filled with toner as explained below. Therefore, this container can be closely fitted in a space below the cleaning device 9 and integrally supported, by a tray 14 in the image forming apparatus, at least in the direction of its motion so that the container can be detached from the image forming apparatus to discard the collected toner or can be replaced for another one.

The tray 14 is movably supported on a fixing member 15 of the image forming apparatus, along the orientation which the toner storage chamber of the container 13 extends; that is, the orientation connecting one end where the toner inlet 13a is formed and the opposite end. The tray 14 is also forced to the opposite direction of the toner inlet 13a of the container 13 by means of a spring 17 stretching between the tray 14 and a spring latch 16 provided on the fixing member 15. The tray 14 preferably contacts with the fixing member 15 via, such as, a resin slider which is made of the material of an appropriate friction coefficient so that the tray can smoothly reciprocate and does not bound. The tray 14 is displaced toward the end at which the toner inlet 13a of the container 13 is provided, as overcoming the force of the spring 17 by the virtue of an actuation means 18 with the form of such as a stepped eccentric cam. When the actuation means 18 loses action by the stepped portion of the cam, etc., the tray 14 repeatedly collides with a fixed bumper in member 19 provided on the fixing member 15 by the force of the spring 17 in the opposite direction. As the actuation means 18, it is possible to use the means such as a stepped cam and electromagnetic plunger other than a stepped eccentric cam.

Collision of the tray 14 with the bumper member 19 minimizes noise, vertical oscillation, and fluctuation in acceleration. Thus, the acceleration achieved is so large that the toner, accepted through the toner inlet 13a into the container 13 that is combined with the tray 14, is conveyed to the other end and allowed to fill the container 13 from the far end. Furthermore, compared to a conventional toner recovery device in which acceleration is obtained by a collision to a bottom of the step of the stepped cam, a reduction ratio, in the acceleration corresponding with the increased quantity of toner stored in the container 13, is significantly minimized by the abovementioned arrangement according to invention and toner is filled in the container 13 in uniform and high density. This operation will be explained using FIG. 5.

Figure 5:
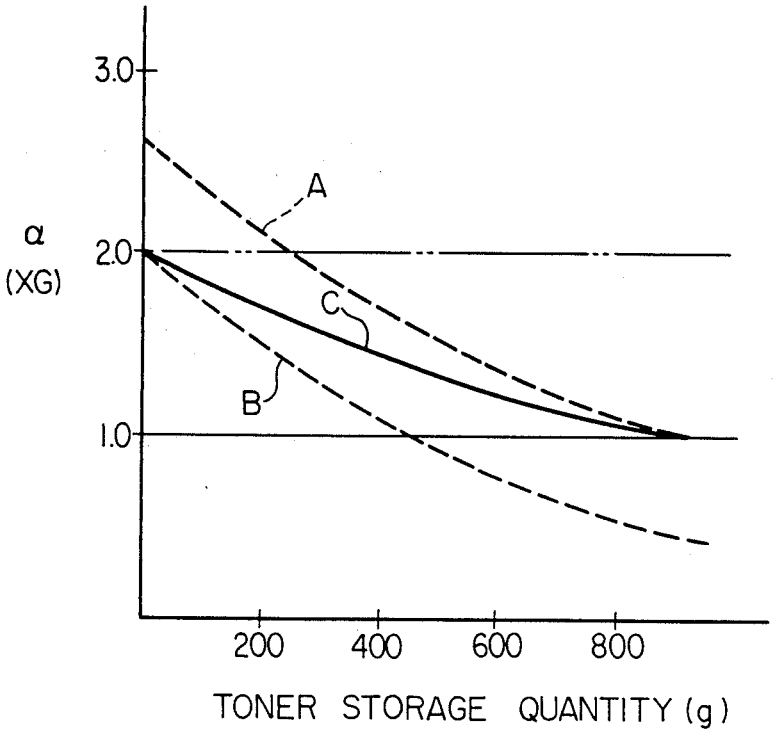
FIG. 5 is a graph showing the correlation between the amount of toner collected in the container and the change in acceleration that the container receives.
Figure 7:
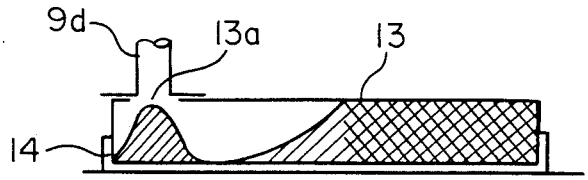
FIG. 7 is a section view of the container in which toner is collected under smaller acceleration.

FIG. 5 shows the correlation between toner storage quantity and negative acceleration $\alpha$ measured at the time of collision. While the broken line A represents a conventional toner recovery device with the speed of a stepped eccentric cam being 140 rpm and the broken line B, 50 rpm, the solid line C indicates the performance of the toner recovery device according to this invention which the speed of the actuation means 18 in FIG. 3 is 50 rpm, and the bumper surface of the bumper member 19 has a shock absorber 19a made of urethane rubber of hardness 65 to 70. For a shock absorber 19a, it is possible to use other kinds of silicone rubber, or natural rubber, foamed rubber, leather, and springs. In FIG. 5, for a conventional toner recovery device, $\alpha$ is preferably not less than 1.0G (G is an acceleration of gravity) to fill the container with toner from the far end, and not more than 2.0G to minimize noise and detrimental oscillation. If $\alpha$ is maintained to be 1.0G or greater even if toner storage quantity increases, $\alpha$ exceeds 2.Gg when toner storage quantity is small, and that increases noise, vertical oscillation, and uneven acceleration. If $\alpha$ is maintained to be 2.0G or smaller, $\alpha$ becomes not more than 1.0G or even not more than 0.5G when toner storage quantity increases. If $\alpha$ becomes not more than 1.0G, toner will fail to fill the container; if not more than 0.5G, toner will not move in the container and form a heap at the toner inlet 13a as shown in FIG. 7. On the contrary, by the toner recovery device according to this invention, $\alpha$ can be maintained to be between 1.0G and 2.0G without controlling $\alpha$, thus minimizing noise, vertical oscillation, and uneven acceleration, and filling the container 13 with toner at high density.

Figure 6:
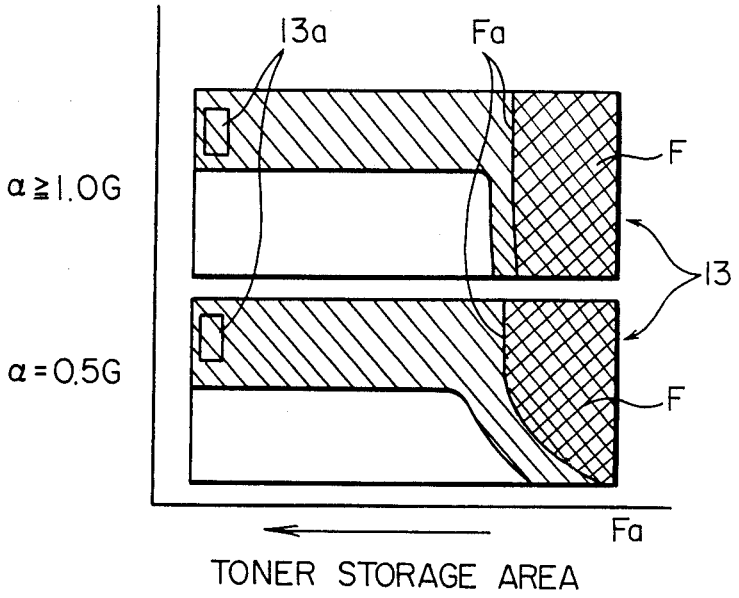
FIG. 6 is a graph showing the correlation between acceleration of the container and state of the toner filled in the container.

FIG. 6 shows the correlation between $\alpha$ and the manner that the container 13 is filled with toner. When $\alpha$ is 1.0G or greater, the toner filling region F of the container 13, which is filled with toner to the ceiling of a storage chamber and shown with the cross-hatching, advances toward the end where the toner inlet 13a is provided while the front line Fa is almost parallel with the far end of the container. Thus, when toner fills up to the toner inlet 13a, the container is almost filled with toner. On the other hand, when $\alpha$ becomes 0.5G, the front line Fa of the toner filling region F retracts at the side wall of the container 13 which is away from the toner inlet 13a. Thus, even when toner fills up the toner inlet 13a, a considerable amount of space remains in the toner storage chamber at the wall where the front line Fa retracts. When $\alpha$ is 0, even if toner fills up the toner inlet 13a, the other part besides the inlet is almost empty. Therefore, $\alpha$ is preferably not less than 0.5G. Especially, when toner has low fluidity or high humidity, $\alpha$ should be preferably not less than 1.0G. In FIG. 6, the cross-hatched area shows where unpacked toner exists and the blank area shows where toner scarcely exists.

The preferable upper limit of $\alpha$ 2.0G, which is mentioned above, is for a conventional toner recovery device which acceleration is obtained by the collision with the bottom surface of the stepped cam. However, with the toner recovery device according to this invention, noise, vertical oscillation, and uneven acceleration can be minimized, and the upper limit of $\alpha$ can be increased up to 3.0G and then container can be filled with toner at high density.

Figure 4:
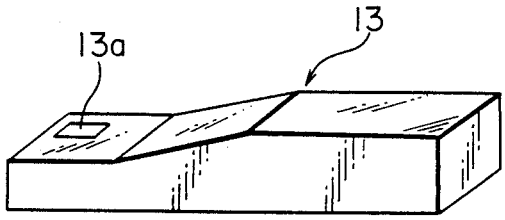
FIG. 4 is a perspective view of an example of the container.

As mentioned above, the toner recovery device according to this invention is able to provide sufficient acceleration by which the container 13 is filled with toner from its far end at high density. Therefore, the toner storage amount in the container 13 can be increased without heightening the part where the toner inlet 13*a* is provided or the entire unit, but with widening the depth between the toner inlet 13*a* and the opposite end or the width perpendicular to the depth. Thus, the container 13 can be fit compactly into the image forming apparatus as mentioned above. Moreover, in order to increase the toner storage quantity of the container 13, the height of the container 13 can be increased at the opposite side to the toner inlet 13*a* as shown in FIG. 4. In this way, the volume of toner is increased at the side being filled at high density, and the toner storage quantity can be increased efficiently.

As mentioned above, removal of toner with replacement of the container 13 can be done in conjunction with the maintenance of the image forming apparatus. The tray 14 is designed that the left wall, which is disposed at a right angle to the direction of reciprocation, can be horizontally pulled down as the example shown in FIG. 1 and the left wall located in the direction of reciprocation can also be done so as the example shown in FIG. 3. In this way, the tray can be inserted and taken out horizontally. In order to realize horizontal installation/removal of the container 13 and prevent scattering of toner from the section where the chute 9*d* of the cleaning device 9 is in contact with the toner inlet 13*a* of the container 13, a flanged cap is provided at the lower part of the chute 9*d*. This flanged cap is preferably installed slidably on the outside of the chute 9*d* so that it comes in contact with the upper surface of the container 13 rather than fixed on the chute 9*d*.

In the toner recovery device according to this invention, in addition to the effects mentioned above, it is also possible to control the acceleration which is to be given to the container 13 by moving the position of the spring latch 16 or the bumper member 19. The control of acceleration by moving the bumper member 19 is limited within the maximum displace range of the tray 14 which is created by the actuation means 18. The position of the spring latch 16 is designed to be shifted by a motor 20 provided under the fixing member 15 as the example shown in FIG. 3, and an acceleration sensor 21 is also provided under the tray 14, whose data are used to control device 22 to drive and control the motor 20 to shift the position of the spring latch 16. Thus, the acceleration can be maintained at a fixed rate regardless of the change of toner quantity in the container 13.

In the example, in which the acceleration sensor 21 is provided as shown in FIG. 3, the acceleration $\alpha$ can be controlled to be constant. Moreover, taking advantage of the fact that $\alpha$ changes in accordance with the toner storage quantity in the container 13 as shown in FIG. 5, and that the spring latch 16 moves to keep $\alpha$ constant, an alarm can be designed to be produced based on this information to notify removal or replacement of toner in the container 13 when the control device judges that the container is full of toner. In this case, higher precision can be obtained if an impact pressure sensor is provided on the fixing member, and the moment of an alarm is judged by comparison between the information from the impact pressure sensor and that of the acceleration sensor 21.

The toner recovery device according to this invention can give sufficient acceleration to fill the container, of which the toner inlet is provided at its one end, with toner. Also, noise, vertical oscillation, and unevenness in acceleration can be minimized and the container is efficiently filled with toner. Therefore, this invention realizes compact structure of the image forming apparatus, and synchronizes the removal timing of collected toner with the maintenance cycle of the image forming apparatus. As a result, it becomes unnecessary to provide a detection means of collected toner, and durability of the device can be increased.

What is claimed is:

1. A toner recovery device, wherein toner on the surface of an image carrying member of an image forming apparatus is removed by a cleaning member and collected in a container, the image forming apparatus including a stationary member having a toner inlet end and an opposite end, the device comprising:

driving means for reciprocatingly moving the container along the stationary member; and bumper means fixed to the stationary member for colliding with the container when the container moves towards the opposite end for applying negative acceleration to stop the movement of the container.

2. The toner recovery device of claim 1, wherein said, bumper means includes a shock absorber.

* * * * *